US009410761B2

(12) United States Patent
Morris et al.

(10) Patent No.: US 9,410,761 B2
(45) Date of Patent: Aug. 9, 2016

(54) SUPPRESSOR WITH CONFIGURABLE BAFFLES

(71) Applicant: Freedom Armory Inc., Glen Rock, PA (US)

(72) Inventors: Scott Wayne Morris, New Fredom, PA (US); Michael Allen Smith, Carlisle, PA (US); Dustin Metcalf Addison, III, York, PA (US)

(73) Assignee: FREEDOM ARMORY INC., Glen Rock, PA (US)

( * ) Notice: Subject to any disclaimer, the term of this patent is extended or adjusted under 35 U.S.C. 154(b) by 0 days.

(21) Appl. No.: 14/795,847

(22) Filed: Jul. 9, 2015

(65) Prior Publication Data

US 2016/0018179 A1 Jan. 21, 2016

Related U.S. Application Data

(60) Provisional application No. 62/025,778, filed on Jul. 17, 2014.

(51) Int. Cl.
*F41A 21/30* (2006.01)
*F41A 21/00* (2006.01)

(52) U.S. Cl.
CPC ..... *F41A 21/30* (2013.01)

(58) Field of Classification Search
CPC ..... F41A 21/30; F41A 21/325
USPC ..... 181/223; 89/14.4, 14.3, 14.2
See application file for complete search history.

(56) References Cited

U.S. PATENT DOCUMENTS

| | | | | | |
|---|---|---|---|---|---|
| 959,400 | A * | 5/1910 | Stinson | F41A 21/30 | 181/223 |
| 1,259,251 | A * | 3/1918 | Love | F41A 21/30 | 181/223 |
| 5,164,535 | A * | 11/1992 | Leasure | F41A 21/30 | 181/223 |
| 6,425,310 | B1 * | 7/2002 | Champion | F41A 21/36 | 89/14.3 |
| 6,575,074 | B1 * | 6/2003 | Gaddini | F41A 21/34 | 89/14.4 |
| 7,308,967 | B1 * | 12/2007 | Hoel | F41A 21/30 | 181/223 |
| 7,832,323 | B1 * | 11/2010 | Davies | F41A 21/30 | 89/14.4 |
| 8,100,224 | B1 * | 1/2012 | Olson | F41A 21/30 | 181/212 |
| 8,516,941 | B1 * | 8/2013 | Oliver | F41A 21/30 | 181/223 |

(Continued)

OTHER PUBLICATIONS

CTD Mike, "Silencer Terms and Tech, Part 2," The Shooter's Log, Cheaper Than Dirt, http://blog.cheaperthandirt.com/silencer-terms-tech-part/, Sep. 15, 2011, Accessed Jun. 2, 2015.

*Primary Examiner* — Edgardo San Martin
(74) *Attorney, Agent, or Firm* — Bennet K. Langlotz; Langlotz Patent & Trademark Works, Inc.

(57) ABSTRACT

A suppressor with configurable baffles has a tubular body defining a bore, a muzzle mount facility on the body, a stack of a plurality of baffles closely received in the bore, each of the baffles defining a primary aperture, each of the baffles having an asymmetric gas flow feature, the primary apertures being aligned on a common axis, each of the baffles having an alignment facility operable to mate with the alignment facility of an adjacent baffle such that a relative rotational position is established, and each alignment facility including a plurality of orientation features at selected rotational intervals about the common axis, such that each baffle is operable to engage an adjacent baffle in a plurality of different alternative orientations at which the respective asymmetric gas flow features are relatively oriented in a selectable position.

19 Claims, 11 Drawing Sheets

(56) References Cited

U.S. PATENT DOCUMENTS 8,579,075 B2 * 11/2013 Brittingham ..... F41A 21/30 181/223
8,714,301 B2 * 5/2014 Shults ..... F41A 21/30 181/223
8,991,550 B2 * 3/2015 Coley ..... F41A 21/30 181/223
2011/0297477 A1 * 12/2011 Koumbis ..... F41A 21/325 181/223
2012/0180624 A1 * 7/2012 Troy ..... F41A 21/30 89/14.4
2012/0272818 A1 * 11/2012 Dueck ..... F41A 21/30 89/14.4
2014/0020977 A1 * 1/2014 Shults ..... F41A 21/30 181/223

* cited by examiner 10
12
14
16
18
20
22
24
26
28
30
32
34
36
38
40
42
44
46
84
86
88
90
92
94
96
98
100
102
104
106
108
110
112
114
116
118
120
122
124
126
128
130
132
134
136
138
140
142
144
146
148
150
152
154
156
184
186
188
190

SUPPRESSOR WITH CONFIGURABLE BAFFLES

CROSS-REFERENCE TO RELATED APPLICATION

This application claims the benefit of U.S. Provisional Patent Application No. 62/025,778 filed on Jul. 17, 2014, entitled "TOTAL SUPPRESSOR BREAKDOWN TECHNOLOGY," which is hereby incorporated by reference in its entirety for all that is taught and disclosed therein.

FIELD OF THE INVENTION

The present invention relates to firearms, and more particularly to a suppressor with baffles that can be configured in a user-selectable orientation to maximize a desired performance characteristic.

BACKGROUND OF THE INVENTION

A suppressor is a device attached to or incorporated into the barrel of a firearm that reduces the amount of noise and also usually the amount of muzzle flash generated by firing the weapon. A suppressor is usually a metal cylinder with internal mechanisms such as baffles to reduce the sound of firing by slowing the escaping propellant gas and sometimes by reducing the velocity of the bullet. The suppressor is typically a hollow cylindrical piece of machined metal (steel, aluminum, or titanium) containing expansion chambers that attaches to the muzzle of a pistol, submachine gun or rifle. These "can"-type suppressors may be attached to and detached from various firearms.

Suppressors reduce noise by allowing the rapidly expanding gases from the firing of the cartridge to be briefly diverted or trapped inside a series of hollow chambers. The trapped gas expands and cools, and its pressure and velocity decreases as it exits the suppressor. The chambers are typically divided by baffles. There are typically a number of chambers in a suppressor, depending on the intended use and design details. Baffles are usually circular metal dividers which separate the expansion chambers. Each baffle has a hole in its center to permit the passage of the bullet through the suppressor and towards the target. Baffles are typically made of stainless steel, aluminum, titanium or alloys such as Inconel, and are either machined out of solid metal, cast, molded, or stamped out of sheet metal.

Baffles may be separated by spacers, which keep them aligned at a specified distance apart inside the suppressor. Many baffles are manufactured as a single assembly with their spacers, and several suppressor designs have all the baffles attached together with spacers as a one-piece "monocore" baffle stack. Modern baffles are usually carefully shaped to divert the propellant gases effectively into the chambers. This shaping can be a slanted flat surface, canted at an angle to the bore, or a conical or otherwise curved surface. One popular technique is to have alternating angled surfaces through the stack of baffles.

Two significant disadvantages exist with existing prior art suppressors. First, current center fire handgun suppressor technology does not allow the user to completely disassemble all the components of the suppressor, including the piston housing and the piece parts down to the unobstructed smooth tube, for cleaning and maintenance without any special tools or manufacturing equipment. Existing technology allows only for partial disassembly, including piston and baffle removal, but excluding the piston housing which is retained/ attached to the inside tube wall. As a result, the cleaning process is degraded because of the user's inability to completely clean the tube. The inability to clean the tube/piston housing interface area permits carbon buildup around the retained piston housing. This carbon buildup degrades the noise reduction performance of the suppressor.

Second, users have been required to use any given prior art suppressor in a fixed design configuration. Handguns and rifles have different muzzle gas pressures using the same ammunition. Because of the pressure differences, and because of the length of the barrel, the configuration of the baffle ports in relation to each other affects the silencer sound reduction performance. A specific example of the performance results achieved through different baffle port arrangements is a comparison of the .22 LR handgun with the .22 LR rifle. When the baffle ports are aligned in a straight orientation, the suppressor performs best on the handgun having a high muzzle gas pressure. When the baffle stack is oriented so each successive baffle port is turned 90° to create a spiral layout, the suppressor performs best on the rifle having a low muzzle gas pressure. As a result, a user seeking optimal performance for both firearm types is required to have two separate prior art suppressors that cannot be transferred without performance degradation between a handgun and a rifle using the same ammunition. Furthermore, it is possible that an individual firearm and ammunition load combination will be best served by an arrangement of baffle ports that is not commercially available in a prior art suppressor, resulting in the user having to settle for a sub-optimal suppressor.

Therefore, a need exists for a new and improved suppressor with configurable baffles that can be configured in a user-selectable orientation to maximize a desired performance characteristic, including sound suppression and/or bullet accuracy. In this regard, the various embodiments of the present invention substantially fulfill at least some of these needs. In this respect, the suppressor with configurable baffles according to the present invention substantially departs from the conventional concepts and designs of the prior art, and in doing so provides an apparatus primarily developed for the purpose of providing a device suppressor with configurable baffles that can be configured in a user-selectable orientation to maximize a desired performance characteristic.

SUMMARY OF THE INVENTION

The present invention provides an improved suppressor with configurable baffles, and overcomes the above-mentioned disadvantages and drawbacks of the prior art. As such, the general purpose of the present invention, which will be described subsequently in greater detail, is to provide an improved suppressor with configurable baffles that has all the advantages of the prior art mentioned above.

To attain this, the preferred embodiment of the present invention essentially comprises a tubular body defining a bore, a muzzle mount facility on the body, a stack of a plurality of baffles closely received in the bore, each of the baffles defining a primary aperture, each of the baffles having an asymmetric gas flow feature, the primary apertures being aligned on a common axis, each of the baffles having an alignment facility operable to mate with the alignment facility of an adjacent baffle such that a relative rotational position is established, and each alignment facility including a plurality of orientation features at selected rotational intervals about the common axis, such that each baffle is operable to engage an adjacent baffle in a plurality of different alternative orientations at which the respective asymmetric gas flow features are relatively oriented in a selectable position. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figures 1A, 1B, 2A:
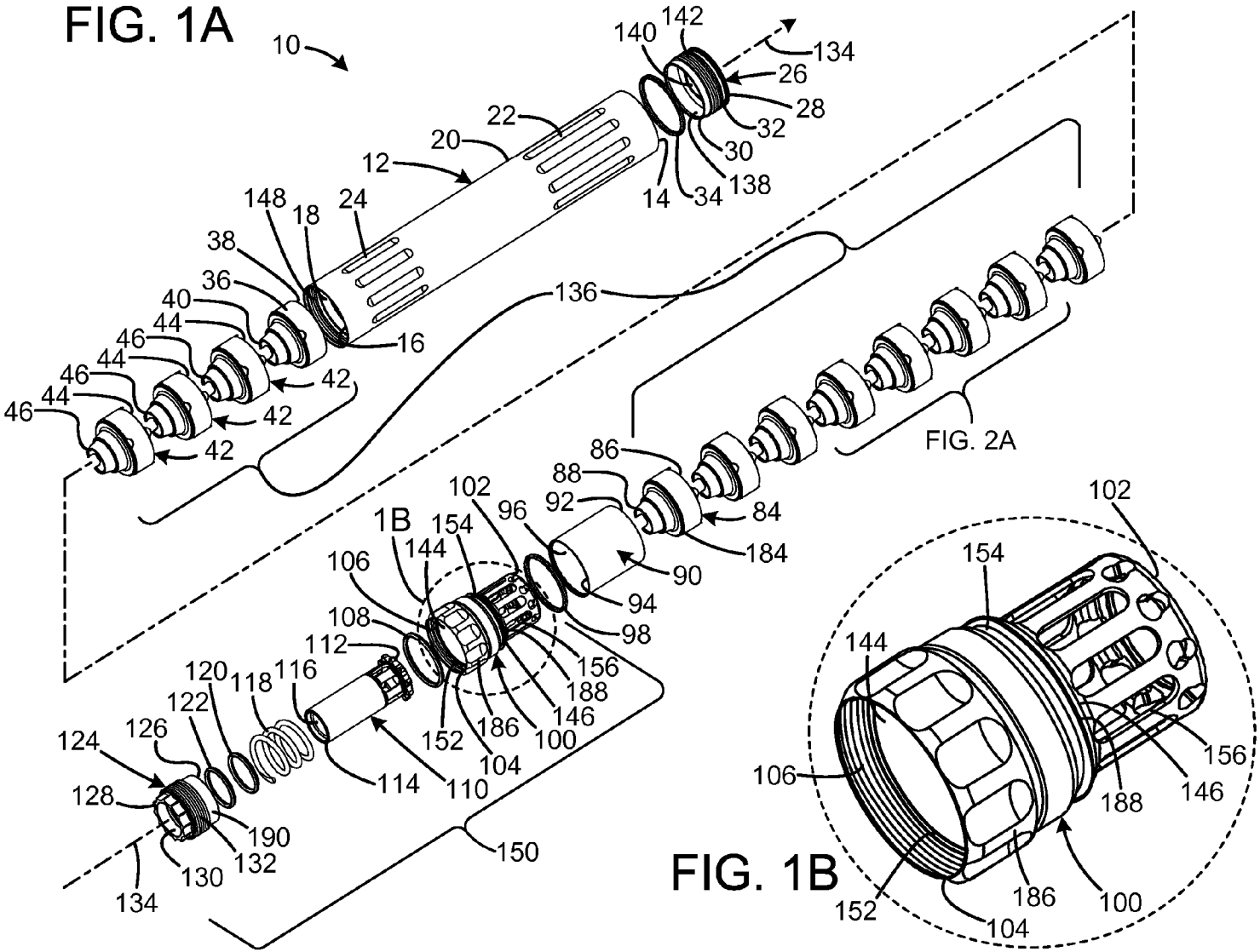
FIG. 1A is an exploded view of the current embodiment of a suppressor with configurable baffles constructed in accordance with the principles of the present invention.
FIG. 1B is an enlarged view of the tubular piston housing of FIG. 1.
FIG. 2A is a front isometric enlarged exploded view of the current embodiment of a portion of the configurable baffles of FIG. 1.
Figure 2A:
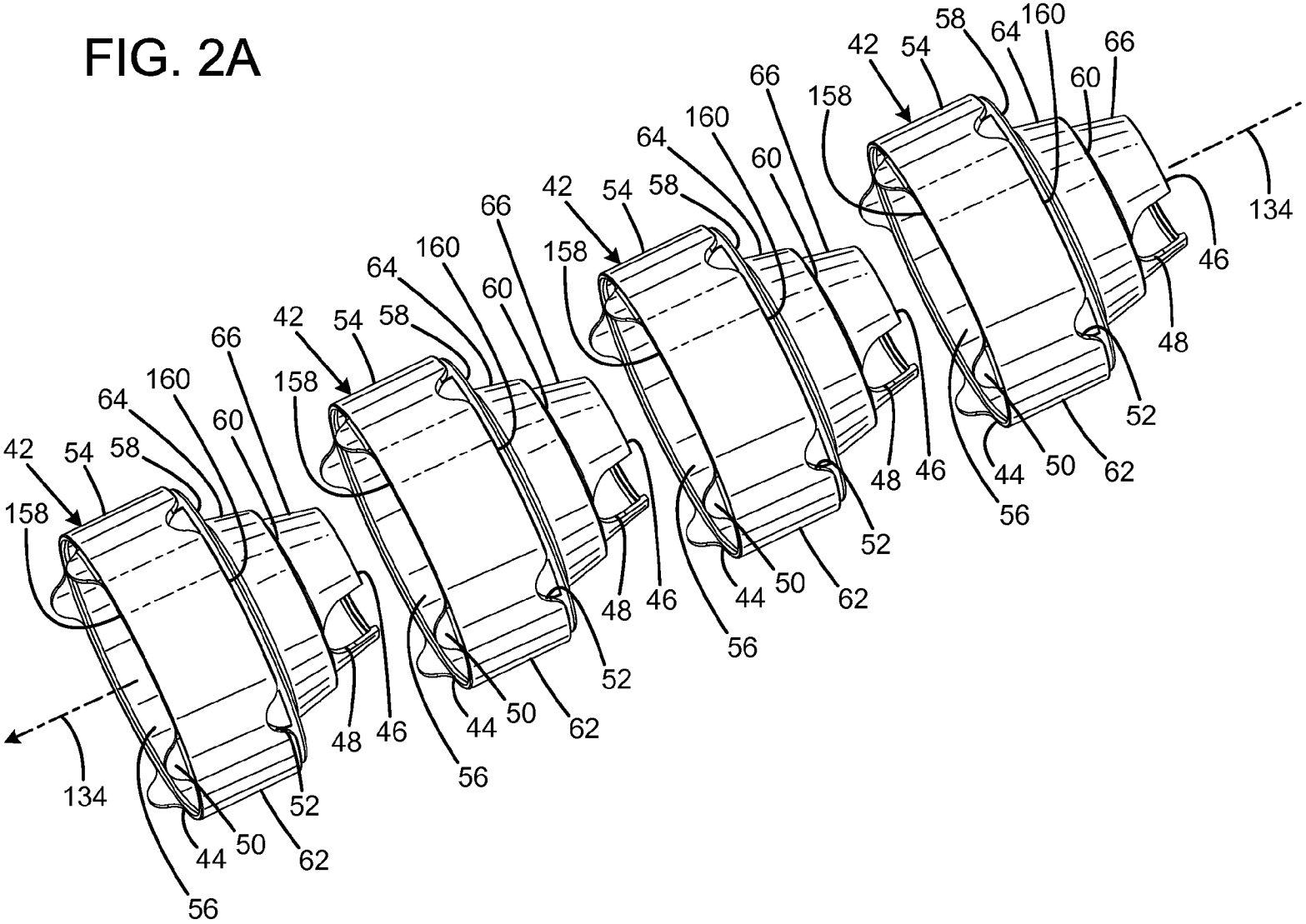
Figure 2B:
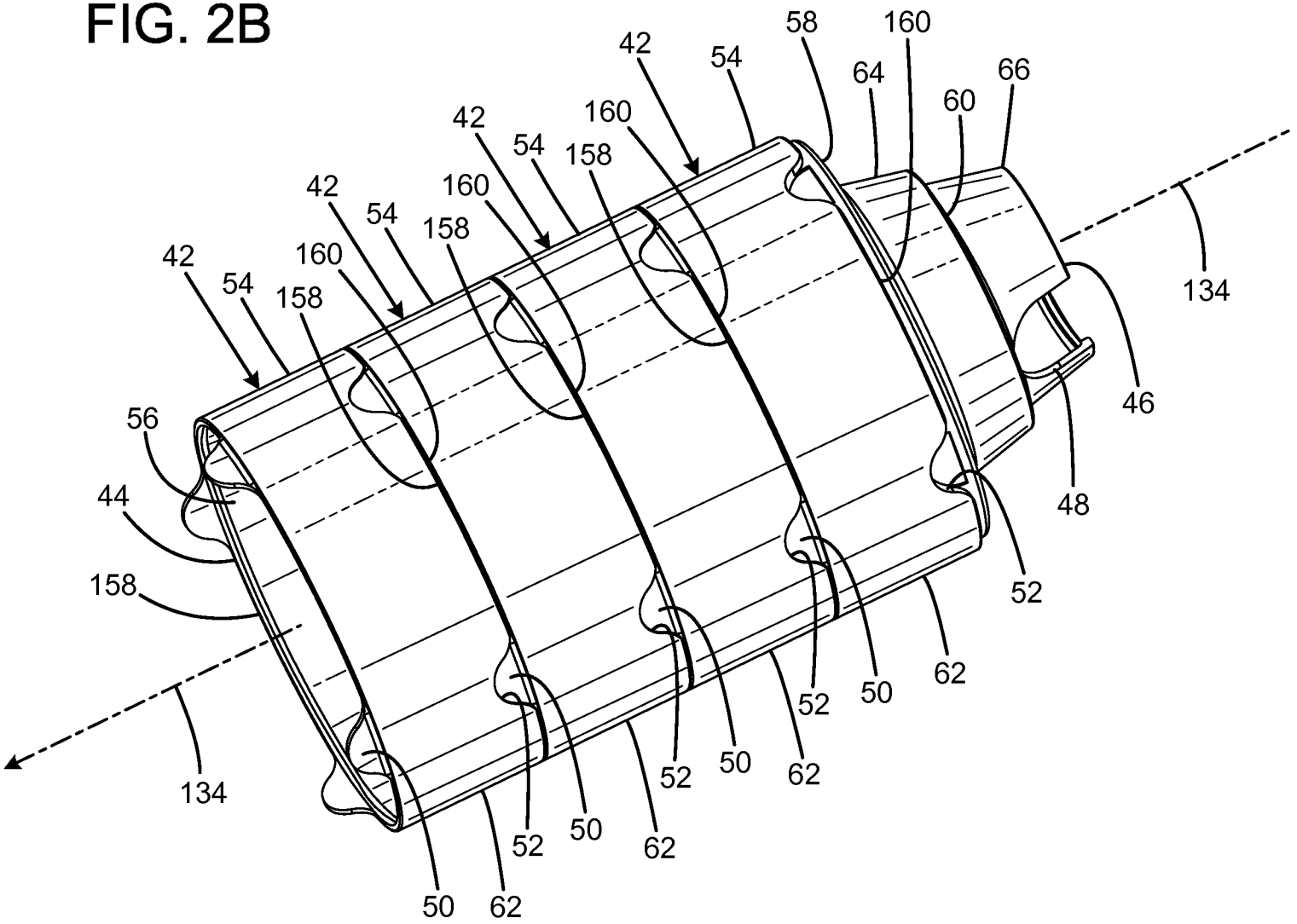
FIG. 2B is a front isometric enlarged view of the configurable baffles of FIG. 2A in an assembled arrangement.
Figure 3:
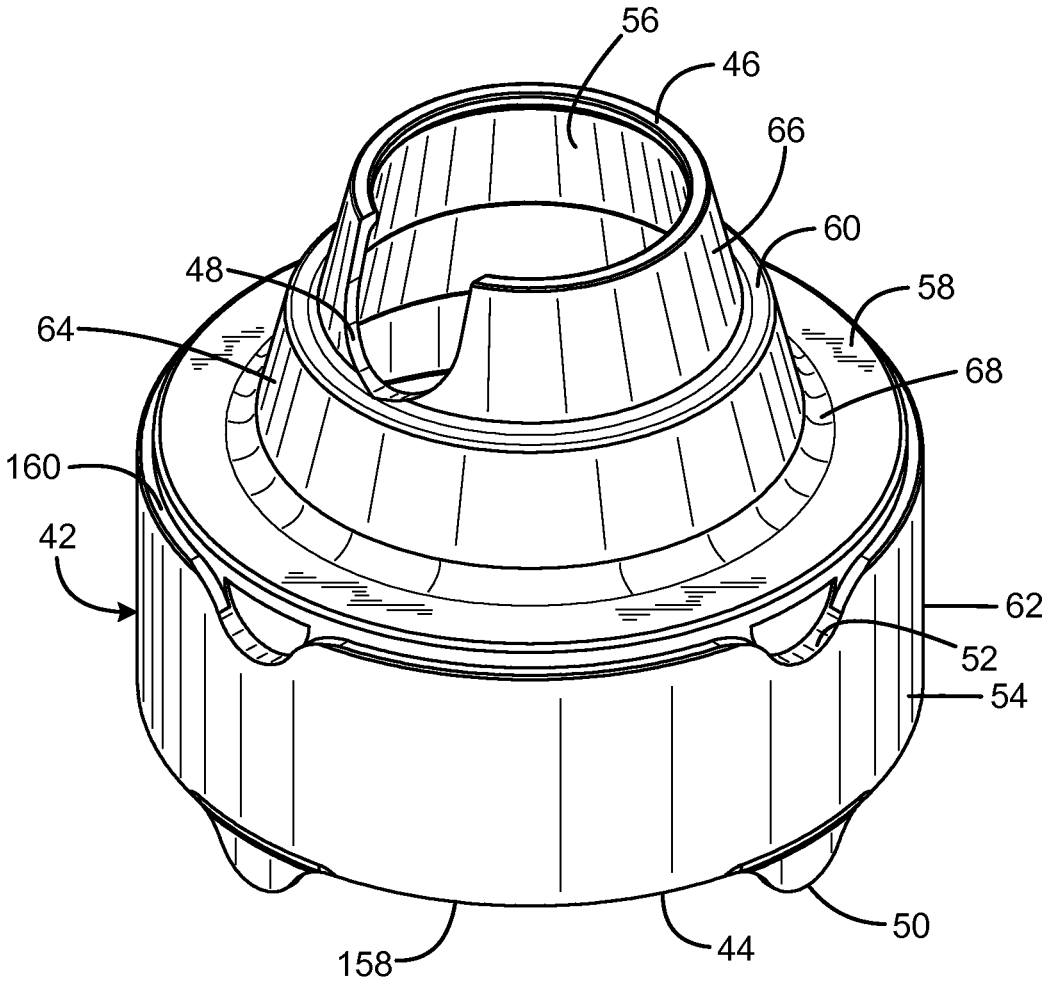
FIG. 3 is a rear isometric view of a configurable baffle of FIG. 1.
Figure 4:
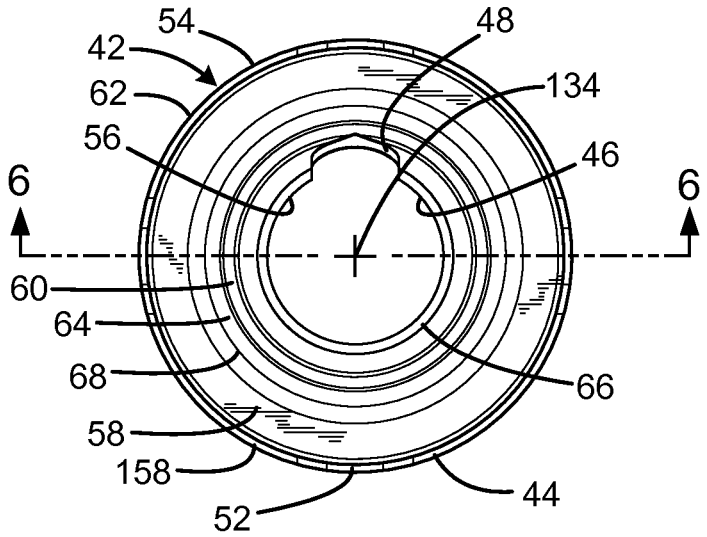
FIG. 4 is a rear view of a configurable baffle of FIG. 1.
Figure 5:
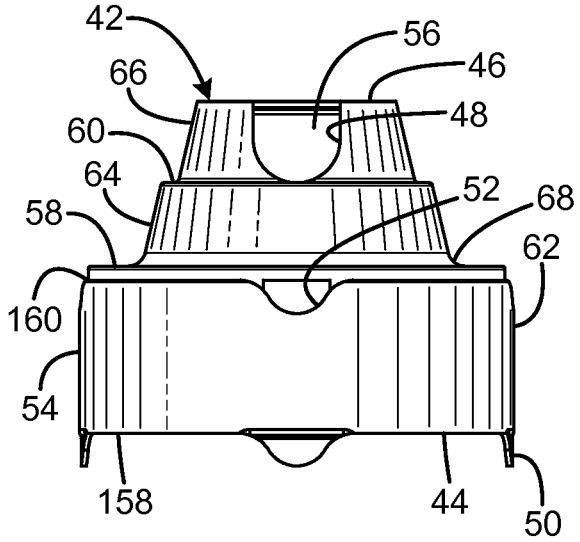
FIG. 5 is a side view of a configurable baffle of FIG. 1.

An embodiment of the suppressor with configurable baffles of the present invention is shown and generally designated by the reference numeral 10.

FIGS. 1A & 1B illustrate the improved suppressor with configurable baffles 10 of the present invention. More particularly, the suppressor has a tubular body 12 having a front 14, a rear 16, a central bore defining an interior 18, an exterior 20, a plurality of front flutes 22, and a plurality of rear flutes 24. The front and rear flutes provide an irregular surface to grab and hold the tubular body when components are being screwed or unscrewed, increases the tubular body's surface area to promote cooling when in use, and provide an attractive appearance. The front interior of the tubular body has female threads (not visible), and the rear interior of the tubular body has female threads 148. A tubular end cap 26 is threadedly connected to the front of the tubular body. The tubular end cap has a front 28, a rear 30, and interior 138, a front aperture 140, a slot 32, and male threads 142. The slot 32 receives an O ring 34 to create a seal between the end cap and the front of the front of the tubular body. The female threads (not visible) in the front interior of the tubular body are located behind a 3/16 inch flat area (not visible) in the current embodiment to provide space for the tubular end cap and O-ring so the front of the tubular end cap is substantially flush with the front of the tubular body when the tubular end cap is installed. The female threads 148 in the rear interior of the tubular body are located in front of a 1/16 inch flat area 190 in the current embodiment.

A baffle stack 136 and a blast sleeve 90 are removably retained within the interior 18 of the tubular body 12 by the end cap 26. The baffle stack includes a forwardmost end baffle 36 having a front 38 and a rear 40, ten standard baffles 42 having a front 44 and a rear 46, and a rearmost starter or blast baffle 84 having a front 86 and a rear 88 for a total of twelve baffles. The tubular blast sleeve 90 has a front 92, rear 94, and interior 96. The front 92 interior 96 of the tubular blast sleeve receives the rear 88 of the starter baffle. The front of the blast sleeve directly contacts the middle shoulder 184 of the starter baffle without any intervening gaps or O-rings. The rear 94 interior 96 of the tubular blast sleeve 90 receives the front 102 of the piston housing 100. The rear of the blast sleeve directly contacts a ridged surface 188 of the piston housing without any intervening gaps or O-rings, leaving the O-ring 98 in slot 154 uncovered by the blast sleeve. The contact between the rear of the blast sleeve and the ridged surface forces carbon resulting from the discharge of a firearm attached to the suppressor 10 into the baffle stack 136. The cleaning procedure to clean accumulated carbon from the baffle stack is much easier than cleaning accumulated carbon from the interior 18 of the tubular body 12.

A piston assembly 150 is threadedly connected to the rear 16 of the tubular body 12. The piston assembly includes a piston nut 124, two O-rings 120, 122, a circular coil spring 118, a piston 110, O-rings 98, 108, and a piston housing 100. The piston assembly 150 is attached by male threads 146 on the piston housing to the female threads 148 inside the rear of the tubular body. The piston assembly is held together by male threads 132 on the piston nut that mate with female threads 106 on the rear 104 of the piston housing.

The tubular piston housing 100 has a front 102, rear 104, an interior 144, a plurality of forward vents 156, male threads 146, female threads 106, a front slot 154, a rear slot 152, and a graspable area 186. O-ring 108 is received within rear slot 152 and creates a seal between the middle interior of the piston housing and the front 126 of the piston nut 124. O-ring 108 prevents carbon from fouling the female threads of the piston housing and the male threads 132 of the piston nut. O-ring 98 is received within front slot 154 and creates a seal between the front of the piston housing and the interior 18 of tubular body 12 that prevents carbon from fouling the threads 148 of the tubular body.

Piston 110 is a tubular body having a front 112, a rear 114, and an interior 116. The piston nut 124 is a tubular body having a front 126, rear 128, and interior 130. The piston and spring 118 are received within the interior 144 of the piston housing 100. The O-rings 120, 122 are received within slots on the interior 130 of the piston nut (not visible) and are retained by the pressure of the piston passing through the piston nut.

The piston assembly 150 of the current invention is a novel version of a Nielsen Device, or recoil booster, which allows an attached firearm to function in a semi-automatic fashion.

Despite employing a piston assembly, the suppressor with configurable baffles 10 has the considerable advantage compared to the prior art of permitting removal of every suppressor component from the tubular body 12, including the piston assembly, to permit cleaning and servicing of all suppressor components and the interior of the tubular body. In the current embodiment, the piston assembly is unscrewed from the tubular body by gripping and turning the graspable area 186 of the tubular piston housing 100, the tubular end cap 26 is unscrewed from the tubular body 12 by turning the tubular end cap with a standard ½ inch drive inserted into the front aperture 140, and the piston nut 124 is unscrewed from the tubular piston housing by turning the piston nut with a standard ⅞ inch socket. All of the suppressor components are axially registered along a common axis that matches a bullet path 134 that a bullet discharged from an attached firearm follows when passing through the suppressor with configurable baffles. In the current embodiment, the suppressor with configurable baffles 10 is sized for a 45 caliber firearm.

FIGS. 2A-6 illustrate the standard baffles 42 of the present invention. More particularly, each standard baffle is a tubular body having a front 44, rear 46, baffle port 48, a plurality of male tabs 50, a plurality of female notches 52, an exterior 54, an interior 56, a middle shoulder 58, a rear shoulder 60, a front tier 62, a middle tier 64, a rear tier 66, and a curved surface 68. The rear of the rear tier and the front of the front tier are open to permit the passage of a bullet through the standard baffle. The baffle port is a notch defined in the rear tier to provide an asymmetric gas flow feature that is an eccentric portion of the primary aperture defined by the interior of the baffles. The tabs and notches are axially aligned with one another and are alignment facilities and orientation features operable such that the tabs on one surface of one baffle mate with the notches on an opposed second surface of an adjacent baffle such that relative rotational position of the baffles is established. The tabs and notches are positioned at the periphery of each baffle and are arranged at selected rotational intervals about the common axis defined by the bullet path 134 such that each baffle is operable to engage in adjacent baffle in a plurality of different alternative orientations at which the respective baffle ports are relatively oriented in a selectable position. In the current embodiment, the tabs and notches are positioned at the periphery of each baffle at equal rotation intervals.

Each tier 62, 64, 66 of the baffle 42 is a shape of differing diameter, with the front tier having a larger diameter than the middle tier, and the middle tier having a larger diameter than the rear tier. The middle tier is connected to the front tier by the curved surface 68 and middle shoulder 58, and the rear tier is connected to the middle tier by the middle shoulder 60. The size of the baffle port 48, slope angle of each tier, and the width of each shoulder can vary based on the design caliber and load pressures of the suppressor 10. In the current embodiment, the front tier is cylindrical in shape, and the middle and rear tiers are conical in shape.

The front tier 62 has a forward edge 158 and a rearward edge 160, with the tabs 50 being defined by the forward edge, and the notches 52 defined by the rearward edge. The forward edge and rearward edge have matched profiles, such that there is no gap between the external surfaces of adjacent baffles 36, 42, 84 in the baffle stack 136. The absence of a gap is most clearly shown in FIG. 2B.

Figure 6:
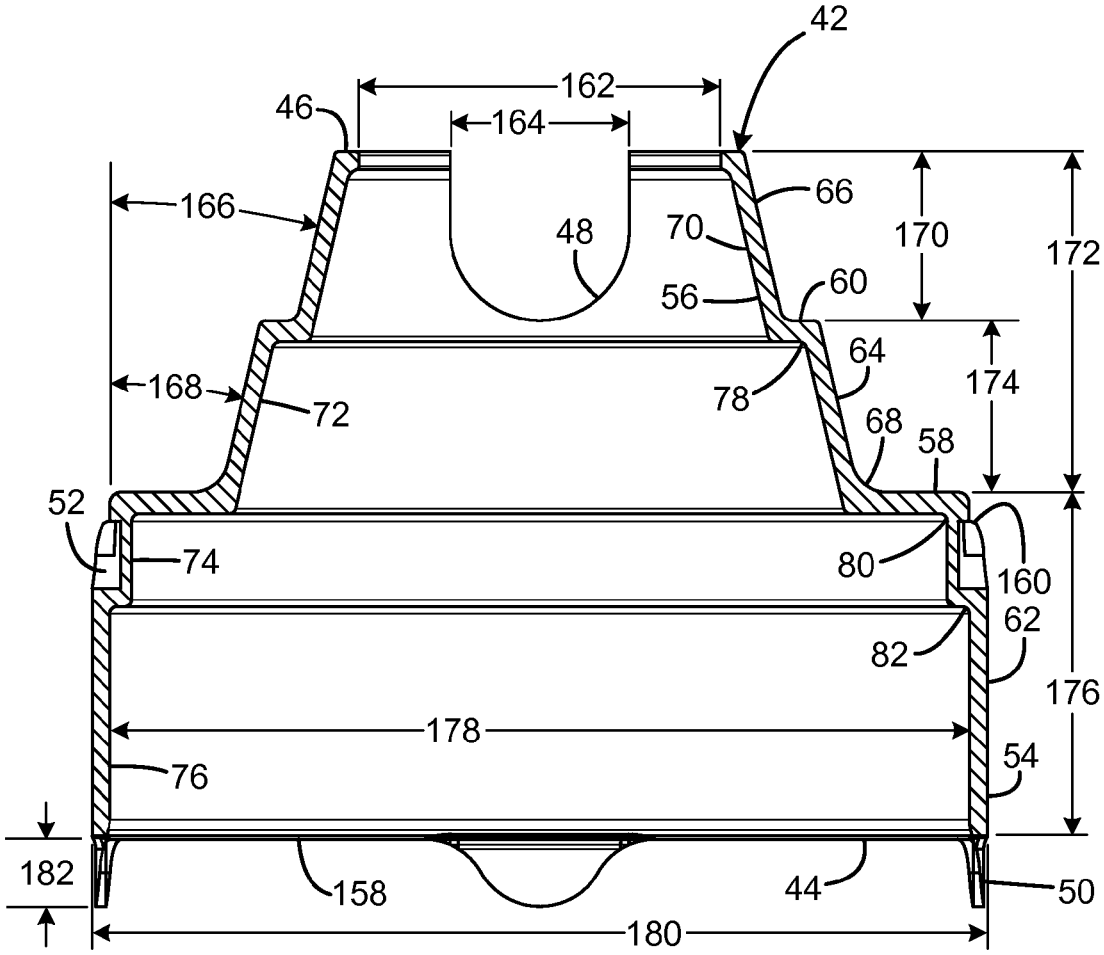
FIG. 6 is a side sectional view taken along line 6-6 of FIG. 4.

As is shown in FIG. 6, the interior 56 of the baffle 42 is divided into a first chamber 70, a second chamber 72, a third chamber 74, and a fourth chamber 76. Each chamber has a different diameter, with the first chamber being smaller than the second chamber, the second chamber being smaller than the third chamber, and the third chamber being smaller than the fourth chamber. Shoulder 78 divides the first chamber from the second chamber, shoulder 80 divides the second chamber from the third chamber, and shoulder 82 divides the third chamber from the fourth chamber. The interior of each baffle is sized to receive the exterior of an adjacent baffle.

The end baffle 36 omits tabs 50 present on the standard baffles 42 and starter baffle 84, but is otherwise identical to a standard baffle. The rear 88 of the starter baffle omits the notches 52 present on the standard baffles, which enables the middle shoulder 184 to form a seal with the front 92 of the blast sleeve 90, but is otherwise identical to a standard baffle. In the current embodiment, width 162 is 0.5050 inch, width 164 is 0.25 inch, angle 166 is 13°, angle 168 is 13°, height 170 is 0.236 inch, height 172 is 0.476 inch, height 174 is 0.240 inch, height 176 is 0.485 inch, width 178 is 1.200 inch, width 180 is 1.250 inch, and height 182 is 0.094 inch. The radius of the baffle port 48 is 0.125.

Figure 7:
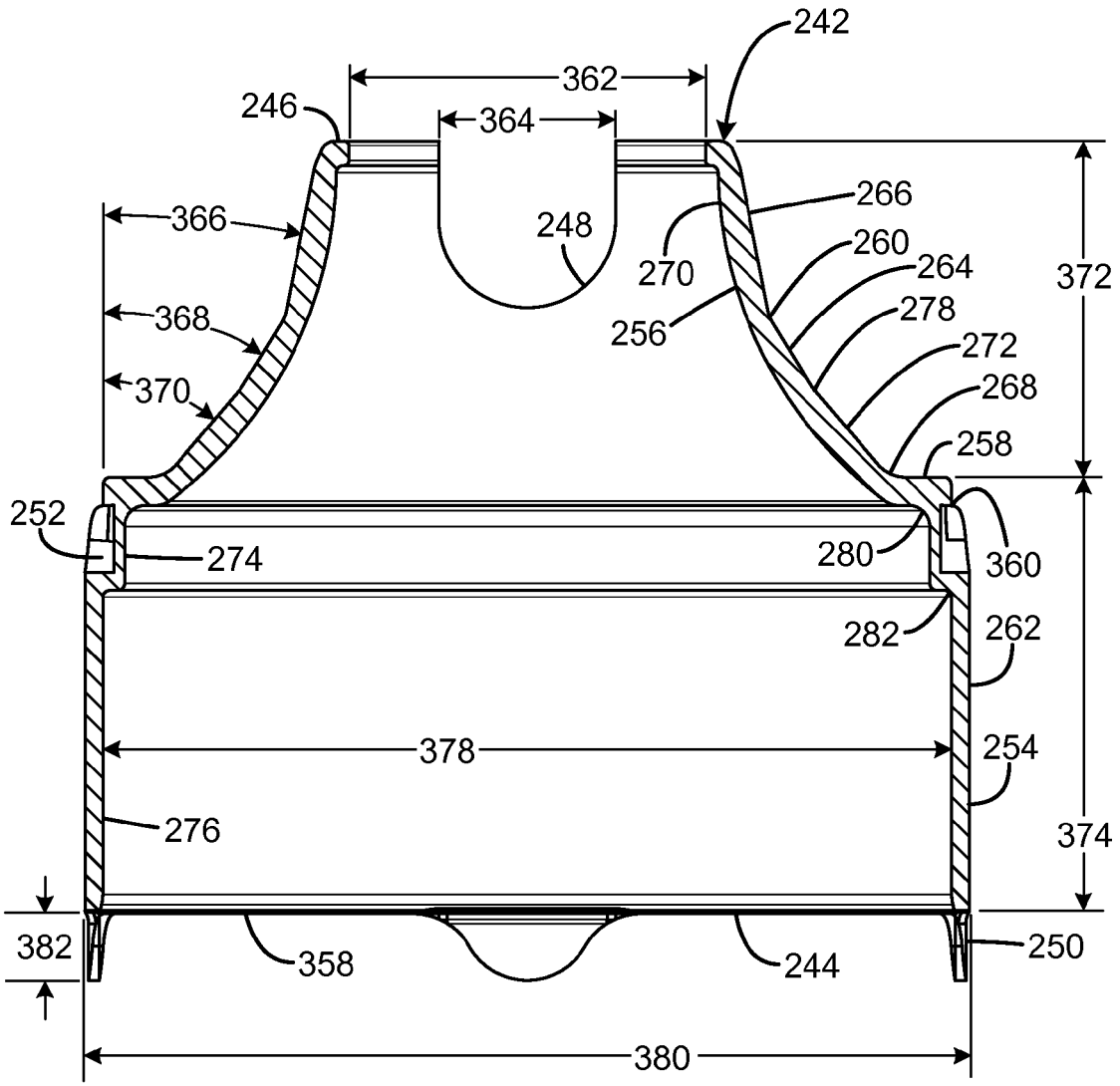
FIG. 7 is a side sectional view of a first alternative embodiment of a configurable baffle constructed in accordance with the principles of the present invention.

FIG. 7 illustrates a first alternative embodiment of the standard baffles 242 of the present invention. More particularly, the first alternative embodiment of the standard baffles 242 reduces the total number of baffles required by the suppressor of the current invention to ten, which makes the invention easier and less costly to produce. Each standard baffle is a tubular body having a front 244, rear 246, baffle port 248, a plurality of male tabs 250, a plurality of female notches 252, an exterior 254, an interior 256, a middle shoulder 258, rear bend points 260, 278, a front tier 262, a front segment 272, a middle segment 264, a rear segment 266, and a curved surface 268. The rear of the rear segment and the front of the front tier are open to permit the passage of a bullet through the standard baffle. The baffle port is a notch defined in the rear tier to provide an asymmetric gas flow feature that is an eccentric portion of the primary aperture defined by the interior of the baffles. The tabs and notches are axially aligned with one another and are alignment facilities and orientation features operable such that the tabs on one surface of one baffle mate with the notches on an opposed second surface of an adjacent baffle such that relative rotational position of the baffles is established. The tabs and notches are positioned at the periphery of each baffle and are arranged at selected rotational intervals about the common axis defined by the bullet path 134 such that each baffle is operable to engage in adjacent baffle in a plurality of different alternative orientations at which the respective baffle ports are relatively oriented in a selectable position. In the current embodiment, the tabs and notches are positioned at the periphery of each baffle at equal rotation intervals.

The baffle 242 possesses differing diameters from front to rear, with the front tier having the largest diameter, and the segments 272, 264, 266 progressively narrowing. The front segment is connected to the front tier by the curved surface 268 and middle shoulder 258, the middle segment is connected to the front segment by bend point 278, and the rear segment is connected to the middle segment by the bend point 260. The term "bend point" is used because the segments appear as a series of line segments joined at these locations when viewed in cross-section. The size of the baffle port 248, slope angle of each segment, and the width of the shoulder can vary based on the design caliber and load pressures of the suppressor 10. In the current embodiment, the front tier is cylindrical in shape, and the segments are generally conical in shape.

The front tier 262 has a forward edge 258 and a rearward edge 360, with the tabs 250 being defined by the forward edge, and the notches 252 defined by the rearward edge. The forward edge and rearward edge have matched profiles, such that there is no gap between the external surfaces of adjacent baffles in the baffle stack.

The interior 256 of the baffle 242 is divided into a first chamber 270, a second chamber 274, and a third chamber 276. Each chamber has a different diameter, with the first chamber being smaller than the second chamber, the second chamber being smaller than the third chamber, and the third chamber being smaller than the fourth chamber. The diameter of the first chamber progressively narrows from front to rear. Shoulder 280 divides the first chamber from the second chamber, and shoulder 282 divides the third chamber from the second chamber. The interior of each baffle is sized to receive the exterior of an adjacent baffle.

An end baffle suitable for use with the standard baffle 242 omits tabs 250 present on the standard baffle 242, but is otherwise identical to a standard baffle. The rear of a starter baffle suitable for use with the standard baffle 242 omits the notches 252 present on the standard baffle, which enables the middle shoulder to form a seal with the front of the blast sleeve, but is otherwise identical to a standard baffle. In the current embodiment, width 362 is 0.5050 inch, width 364 is 0.25 inch, angle 366 is 11.17°, angle 368 is 31.65°, angle 370 is 40.44°, height 372 is 0.476 inch, height 374 is 0.618 inch, width 378 is 1.200 inch, width 380 is 1.250 inch, and height 382 is 0.094 inch. The radius of the baffle port 248 is 0.125. The bend points 260, 278 each have a radius of 0.05.

Figure 8:
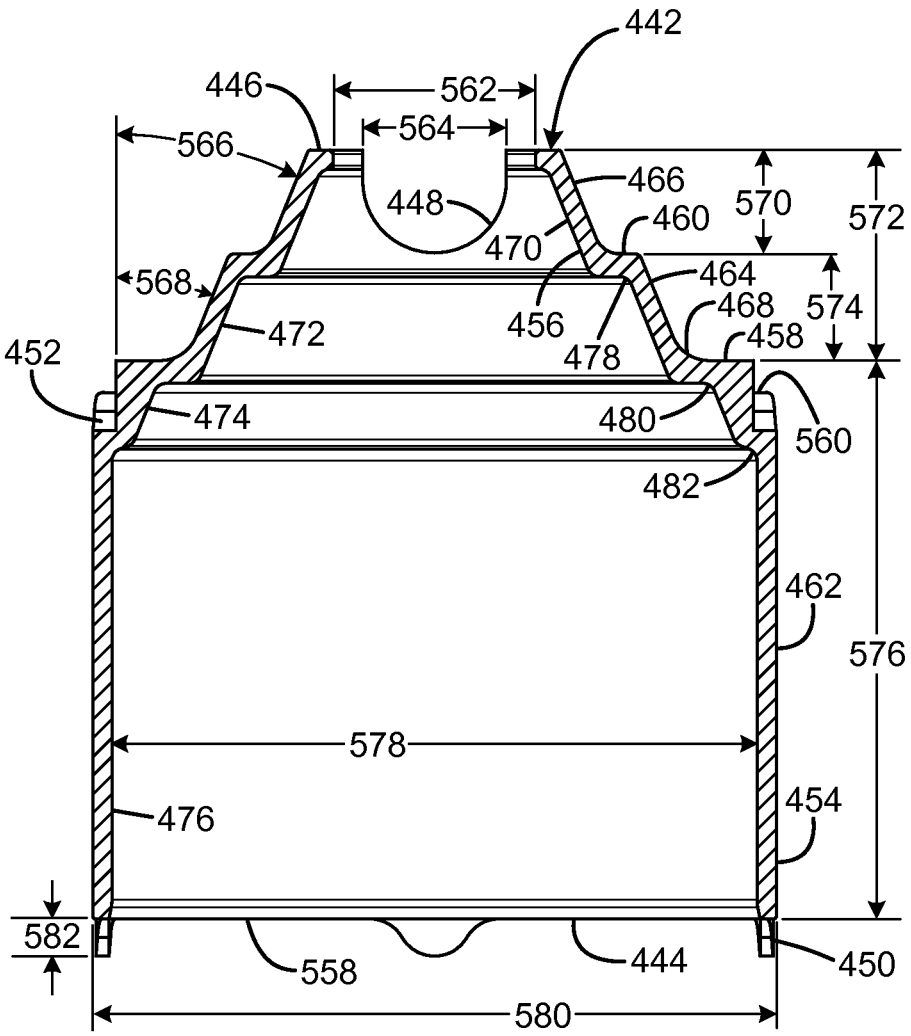
FIG. 8 is a side sectional view of a second alternative embodiment of a configurable baffle constructed in accordance with the principles of the present invention.

FIG. 8 illustrates a second alternative embodiment of the standard baffles 442 of the present invention. More particularly, the second alternative embodiment of the standard baffles 442 is sized for a 22 caliber firearm. Each standard baffle is a tubular body having a front 444, rear 446, baffle port 448, a plurality of male tabs 450, a plurality of female notches 452, an exterior 454, an interior 456, a middle shoulder 458, a rear shoulder 460, a front tier 462, a middle tier 464, a rear tier 466, and a curved surface 468. The rear of the rear tier and the front of the front tier are open to permit the passage of a bullet through the standard baffle. The baffle port is a notch defined in the rear tier to provide an asymmetric gas flow feature that is an eccentric portion of the primary aperture defined by the interior of the baffles. The tabs and notches are axially aligned with one another and are alignment facilities and orientation features operable such that the tabs on one surface of one baffle mate with the notches on an opposed second surface of an adjacent baffle such that relative rotational position of the baffles is established. The tabs and notches are positioned at the periphery of each baffle and are arranged at selected rotational intervals about the common axis defined by the bullet path 134 such that each baffle is operable to engage in adjacent baffle in a plurality of different alternative orientations at which the respective baffle ports are relatively oriented in a selectable position. In the current embodiment, the tabs and notches are positioned at the periphery of each baffle at equal rotation intervals.

Each tier 462, 464, 466 of the baffle 442 is a shape of differing diameter, with the front tier having a larger diameter than the middle tier, and the middle tier having a larger diameter than the rear tier. The middle tier is connected to the front tier by the curved surface 468 and middle shoulder 458, and the rear tier is connected to the middle tier by the middle shoulder 460. The size of the baffle port 448, slope angle of each tier, and the width of each shoulder can vary based on the design caliber and load pressures of the suppressor 10. In the current embodiment, the front tier is cylindrical in shape, and the middle and rear tiers are conical in shape.

The front tier 462 has a forward edge 558 and a rearward edge 560, with the tabs 450 being defined by the forward edge, and the notches 452 defined by the rearward edge. The forward edge and rearward edge have matched profiles, such that there is no gap between the external surfaces of adjacent baffles in the baffle stack.

The interior 456 of the baffle 442 is divided into a first chamber 470, a second chamber 472, a third chamber 474, and a fourth chamber 476. Each chamber has a different diameter, with the first chamber being smaller than the second chamber, the second chamber being smaller than the third chamber, and the third chamber being smaller than the fourth chamber. Shoulder 478 divides the first chamber from the second chamber, shoulder 480 divides the second chamber from the third chamber, and shoulder 482 divides the third chamber from the fourth chamber. The interior of each baffle is sized to receive the exterior of an adjacent baffle.

An end baffle suitable for use with the standard baffle 442 omits tabs 450 present on the standard baffle 442, but is otherwise identical to a standard baffle. The rear of a starter baffle suitable for use with the standard baffle 242 omits the notches 452 present on the standard baffle, which enables the middle shoulder to form a seal with the front of the blast sleeve, but is otherwise identical to a standard baffle. In the current embodiment, width 562 is 0.265 inch, width 564 is 0.188 inch, angle 566 is 22°, angle 568 is 22°, height 570 is 0.136 inch, height 572 is 0.276 inch, height 574 is 0.140 inch, height 576 is 0.732 inch, width 578 is 0.845 inch, width 580 is 0.895 inch, and height 582 is 0.049 inch. The radius of the baffle port 448 is 0.094.

Figure 9:
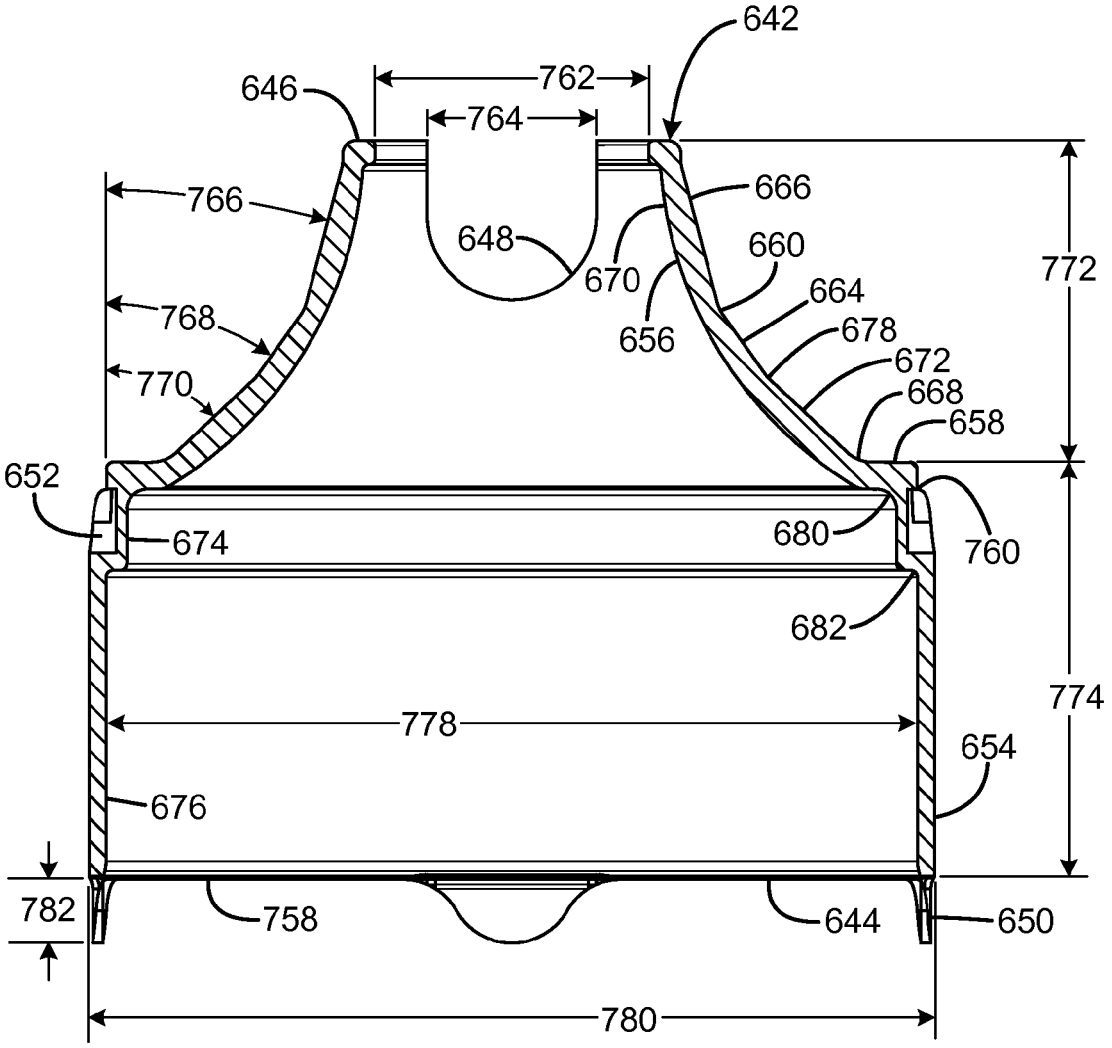
FIG. 9 is a side sectional view of a third alternative embodiment of a configurable baffle constructed in accordance with the principles of the present invention.
Figure 10B:
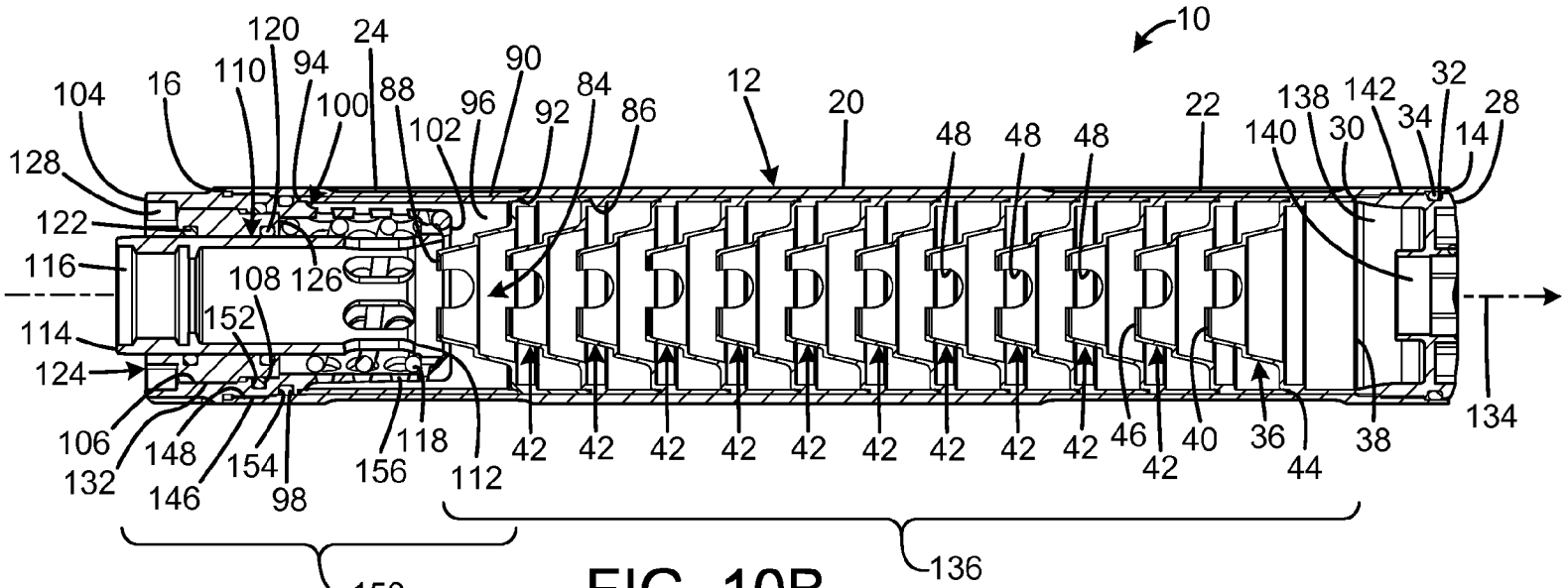
FIG. 10B is a side sectional view taken along line 10B-10B of FIG. 10A.
Figure 10A:
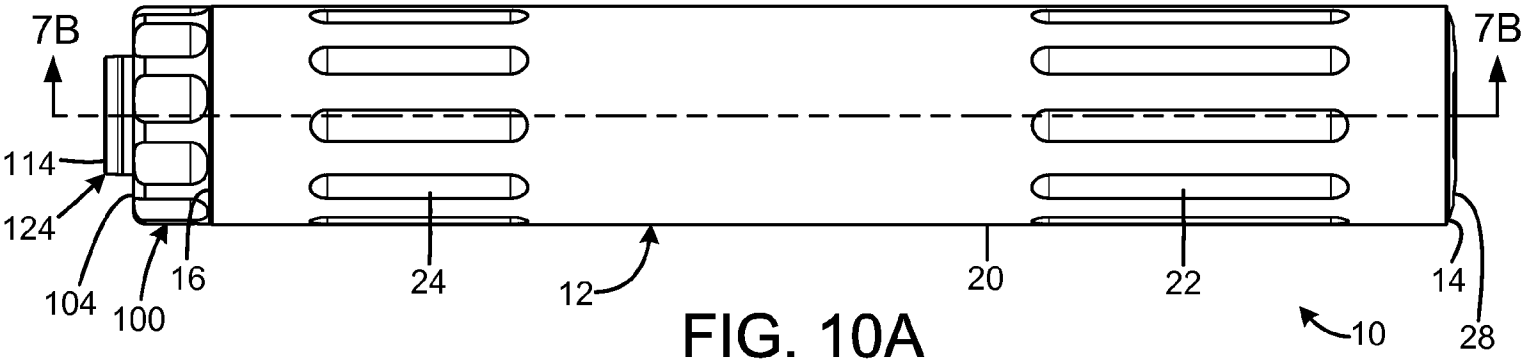
FIG. 10A is a side view of the suppressor with configurable baffles of FIG. 1 with the configurable baffles configured to align the baffle ports in registration.
Figure 11B:
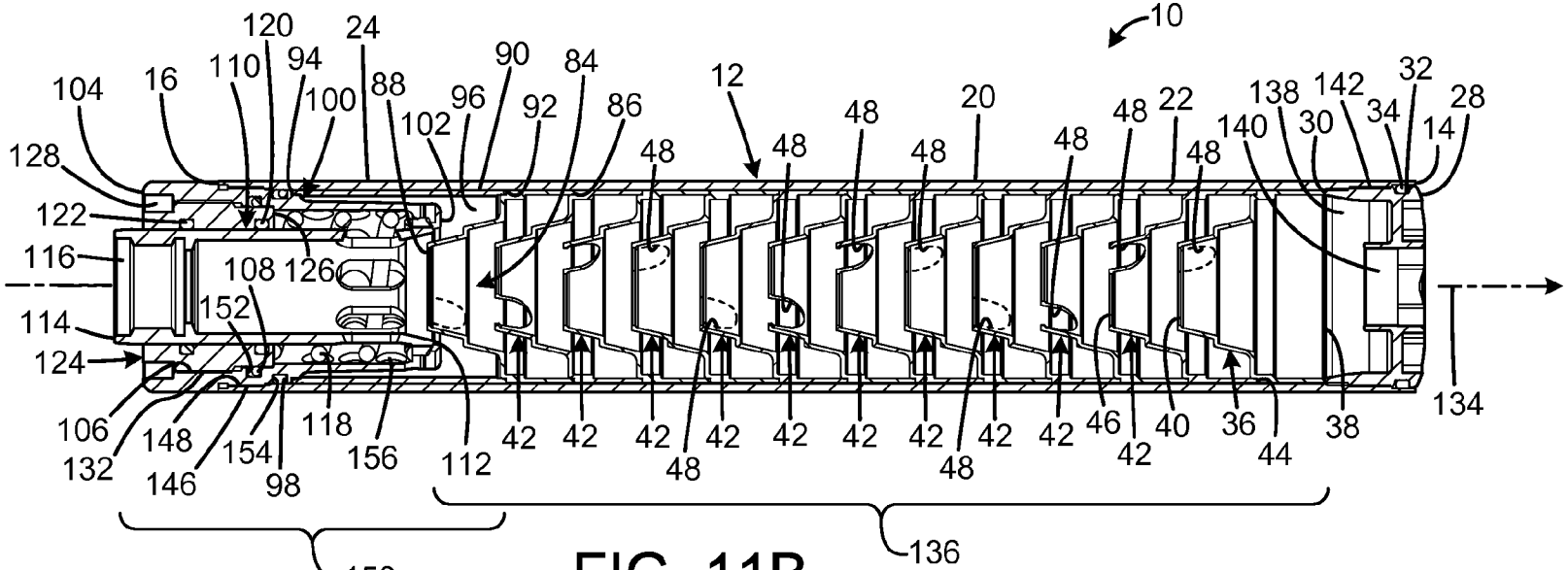
FIG. 11B is a side sectional view taken along line 11B-11B of FIG. 11A.
Figure 11A:
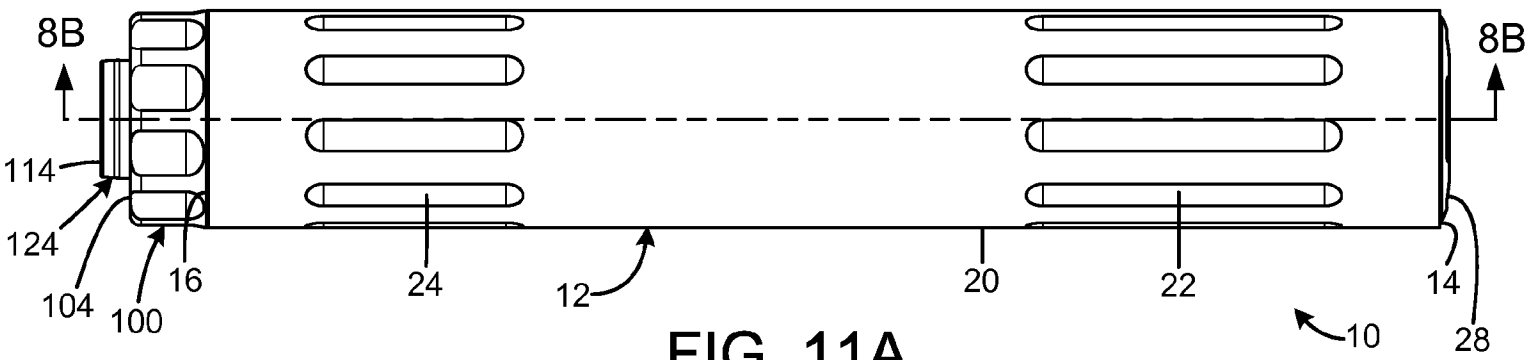
FIG. 11A is a side view of the suppressor with configurable baffles of FIG. 1 with the configurable baffles configured to index the baffle ports by 90° in a spiral orientation.

FIG. 9 illustrates a third alternative embodiment of the standard baffles 642 of the present invention. More particularly, the third alternative embodiment of the standard baffles 642 is sized for a 9 mm firearm. Each standard baffle is a tubular body having a front 644, rear 646, baffle port 648, a plurality of male tabs 650, a plurality of female notches 652, an exterior 654, an interior 656, a middle shoulder 658, rear bend points 660, 678, a front tier 662, a front segment 672, a middle segment 664, a rear segment 666, and a curved surface 668. The rear of the rear segment and the front of the front tier are open to permit the passage of a bullet through the standard baffle. The baffle port is a notch defined in the rear tier to provide an asymmetric gas flow feature that is an eccentric portion of the primary aperture defined by the interior of the baffles. The tabs and notches are axially aligned with one another and are alignment facilities and orientation features operable such that the tabs on one surface of one baffle mate with the notches on an opposed second surface of an adjacent baffle such that relative rotational position of the baffles is established. The tabs and notches are positioned at the periphery of each baffle and are arranged at selected rotational intervals about the common axis defined by the bullet path 134 such that each baffle is operable to engage in adjacent baffle in a plurality of different alternative orientations at which the respective baffle ports are relatively oriented in a selectable position. In the current embodiment, the tabs and notches are positioned at the periphery of each baffle at equal rotation intervals.

The baffle 642 possesses differing diameters from front to rear, with the front tier having the largest diameter, and the segments 672, 664, 666 progressively narrowing. The front segment is connected to the front tier by the curved surface 668 and middle shoulder 658, the middle segment is connected to the front segment by bend point 678, and the rear segment is connected to the middle segment by the bend point 660. The term "bend point" is used because the segments appear as a series of line segments joined at these locations when viewed in cross-section. The size of the baffle port 648, slope angle of each segment, and the width of the shoulder can vary based on the design caliber and load pressures of the suppressor 10. In the current embodiment, the front tier is cylindrical in shape, and the segments are generally conical in shape.

The front tier 662 has a forward edge 658 and a rearward edge 760, with the tabs 650 being defined by the forward edge, and the notches 652 defined by the rearward edge. The forward edge and rearward edge have matched profiles, such that there is no gap between the external surfaces of adjacent baffles in the baffle stack.

The interior 656 of the baffle 642 is divided into a first chamber 670, a second chamber 674, and a third chamber 676. Each chamber has a different diameter, with the first chamber being smaller than the second chamber, the second chamber being smaller than the third chamber, and the third chamber being smaller than the fourth chamber. The diameter of the first chamber progressively narrows from front to rear. Shoulder 680 divides the first chamber from the second chamber, and shoulder 682 divides the third chamber from the second chamber. The interior of each baffle is sized to receive the exterior of an adjacent baffle.

An end baffle suitable for use with the standard baffle 642 omits tabs 650 present on the standard baffle 642, but is otherwise identical to a standard baffle. The rear of a starter baffle suitable for use with the standard baffle 642 omits the notches 652 present on the standard baffle, which enables the middle shoulder to form a seal with the front of the blast sleeve, but is otherwise identical to a standard baffle. In the current embodiment, width 762 is 0.4050 inch, width 764 is 0.25 inch, angle 766 is 14.73°, angle 768 is 35.48°, angle 770 is 46.70°, height 772 is 0.476 inch, height 774 is 0.618 inch, width 778 is 1.200 inch, width 780 is 1.250 inch, and height 782 is 0.094 inch. The radius of the baffle port 248 is 0.125. The bend points 660, 678 each have a radius of 0.05.

FIGS. 10A-11B illustrate improved suppressor with configurable baffles 10 of the present invention. More particularly, the suppressor is shown with the baffle stack 136 configured to align the baffle ports 48 in registration in FIGS. 10A-B and with the baffle stack configured to index the baffle ports by 90° in a spiral or helical orientation in FIGS. 11A-B. Unlike prior art suppressors that have baffle stacks arranged in a fixed configuration that is unalterable by the user, the current invention permits the user to disassemble and reassemble the baffle stack with the baffle ports arranged in any of the orientations achieved by aligning the tabs 50 with the notches 52 of adjacent baffles 84, 42, 36. This feature enables the user to arrange the baffle ports to optimize desired performance characteristics, such as sound suppression and bullet accuracy, to an individual firearm, ammunition load, and/or mission. The tabs and notches enable the baffles to be arranged in a controlled, repeatable orientation to facilitate reassembly of the suppressor after cleaning and maintenance that is also modifiable and selectable.

One example of the utility of the ability to configure the baffle stack 136 to an individual firearm is the ability to transfer the suppressor with configurable baffles 10 from a high muzzle pressure to a low muzzle pressure or low muzzle pressure to high muzzle pressure host firearm while maintaining sound reduction performance. When the baffle ports 48 are aligned in a straight orientation, the suppressor 10 performs best on a high muzzle pressure handgun; and when the baffle stack orients each successive baffle port 90° to create a spiral layout, the suppressor 10 performs best on a low muzzle pressure rifle. Thus, the user can reconfigure the baffle ports any number of times to transfer the suppressor back and forth between a handgun and a rifle.

While current embodiments of a suppressor with configurable baffles have been described in detail, it should be apparent that modifications and variations thereto are possible, all of which fall within the true spirit and scope of the invention. For example, although a four tabs and notches embodiment per baffle is disclosed with the tabs and notches rotationally offset by 90°, as few as one tab and notch per baffle, or a plurality of serrations of any pitch engaged by at least one tab, could be used depending on the intended host firearm(s). Furthermore, the tabs and notches can be arranged so that the baffle ports of adjacent baffles are offset by as little as 0° and as much as 180° from one another in the four tabs and notches embodiment. In addition to the 10 and 12 total baffle embodiments disclosed, the invention is suitable for use with any total number of baffles. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A firearm suppressor comprising:

a tubular body defining a bore on a bore axis;

a muzzle mount facility on the body;

a stack of a plurality of baffles closely received in the bore;

each of the baffles defining a primary aperture; each of the baffles having an asymmetric gas flow feature;

the primary apertures being aligned on a common axis; each of the baffles having an alignment facility operable to mate with the alignment facility of an adjacent baffle such that a relative rotational position is established; and each alignment facility including a plurality of more than two orientation features at selected rotational intervals about the common axis, such that each baffle is operable to engage an adjacent baffle in a plurality of different alternative orientations at which the respective asymmetric gas flow features are relatively oriented in a selectable position, with at least one of the gas flow features being selectably positioned in an orientation outside of a common plane with the other gas flow features.

2. The firearm suppressor of claim 1 wherein each baffle has orientation features including at least a male element on one surface and at least a female element on an opposed second surface.

3. The firearm suppressor of claim 2 including a plurality of male elements.

4. The firearm suppressor of claim 2 including a plurality of female elements.

5. The firearm suppressor of claim 1 wherein the orientation features are positioned at the periphery of each baffle.

6. The firearm suppressor of claim 1 wherein the orientation features are positioned at equal rotation intervals.

7. The firearm suppressor of claim 1 wherein the asymmetric gas flow feature is an eccentric portion of the primary aperture.

8. The firearm suppressor of claim 1 including four orientation features on at least one surface of the baffle, such that four alternative orientations are provided.

9. The firearm suppressor of claim 1 wherein each baffle has a cylindrical external surface having a forward edge and a rearward edge, and wherein each of the orientation features is defined by one of the forward edge and rearward edge.

10. The firearm suppressor of claim 9 wherein the forward edge and rearward edge have matched profiles, such that there is no gap between the external surfaces of adjacent baffles in the stack.

11. The firearm suppressor of claim 1 wherein the asymmetric gas flow features are registered with each other.

12. The firearm suppressor of claim 1 wherein the asymmetric gas flow features are aligned in an alternating pattern in which the asymmetric gas flow feature of each baffle is offset from the asymmetric gas flow feature of each adjacent baffle by 180°.

13. The firearm suppressor of claim 1 wherein the asymmetric gas flow features are aligned in a helical pattern.

14. The firearm suppressor of claim 13 wherein the asymmetric gas flow feature of each baffle is offset from the asymmetric gas flow feature of each adjacent baffle by 90°.

15. The firearm suppressor of claim 1 wherein each of the orientation features is formed in a mating surface facing in an axial direction along the bore such that the baffles may be joined with each other and separated from other in an axial direction.

16. The firearm suppressor of claim 15 wherein the mating surface is a continuous rim encompassing the baffle and defining the largest diameter portion of the baffle.

17. The firearm suppressor of claim 16 wherein each baffle has a smooth cylindrical exterior extending from a forward mating surface to a rear mating surface.

18. The firearm suppressor of claim 1 wherein there are 4 orientation features such that the gas flow features may be positioned at any orthogonal position.

19. The firearm suppressor of claim 1 wherein the orientation features are positioned at 90 degree angles with respect to each other.

* * * * *